US005820338A

United States Patent [19]

Kasprow et al.

[11] Patent Number: 5,820,338

[45] Date of Patent: Oct. 13, 1998

[54] FAN BLADE INTERPLATFORM SEAL

[75] Inventors: Robert F. Kasprow, Wethersfield; Phyllis L. Kurz, Hebron; Jeffrey S. LeShane, Glastonbury, all of Conn.

[73] Assignee: United Technologies Corporation, Hartford, Conn.

[21] Appl. No.: 839,999

[22] Filed: Apr. 24, 1997

[51] Int. Cl.[6] ..... F01D 25/26

[52] U.S. Cl. ..... 415/134; 415/138; 415/170.1

[58] Field of Search ..... 415/134, 135, 415/136, 137, 138, 139, 170.1, 193 A

[56] References Cited

U.S. PATENT DOCUMENTS

| | | | |
|---|---|---|---|
| 4,326,835 | 4/1982 | Wertz | 416/193 A |
| 4,422,827 | 12/1983 | Buxe et al. | 416/193 A |
| 4,505,642 | 3/1985 | Hill | 416/193 A |
| 5,421,704 | 6/1995 | Carletti et al. | 416/193 A |
| 5,513,955 | 5/1996 | Barcza | 416/193 A |

*Primary Examiner*—John T. Kwon

*Attorney, Agent, or Firm*—Monica G. Krasinski

[57] ABSTRACT

The present invention relates to a seal interposed between platforms of blades for a fan in an axial gas turbine engine. Modern impact resistant fan blades have larger interplatform gaps. As a result, the interplatform seals have to seal a large gap. The seal is stiffened such that it can withstand centrifugal forces due to fan operation. In addition, various construction derails are developed for the stiffened seal.

4 Claims, 4 Drawing Sheets

FAN BLADE INTERPLATFORM SEAL

TECHNICAL FIELD

The present invention relates to gas turbine engines, and more particularly, to seals interposed between platforms of blades for a fan in the engine.

DESCRIPTION OF THE PRIOR ART

A gas turbine engine, such as a turbofan engine for an aircraft, includes a fan section, a compression section, a combustion section, and a turbine section. An axis of the engine is centrally disposed within the engine, and extends longitudinally through these sections. A primary flow path for working medium flow gases extends axially through the sections of the engine. A secondary flow path for working medium gases extends parallel to and radially outward of the primary flow path.

The fan section includes a rotor assembly and a stator assembly. The rotor assembly of the fan includes a rotor disk and a plurality of outwardly extending rotor blades. Each rotor blade includes an airfoil portion, a dovetailed root portion, and a platform. The airfoil portion extends through the flow path and interacts with the working medium gases to transfer energy between the rotor blade and working medium gases. The dovetailed root portion engages the attachment means of the rotor disk. The platform typically extends circumferentially from the rotor blade to a platform of an adjacent rotor blade. The platform is disposed radially between the airfoil portion and the root portion. The stator assembly includes a fan case, which circumscribes the rotor assembly in close proximity to the tips of the rotor blades.

During operation, the fan draws the working medium gases, more particularly air, into the engine. The fan raises the pressure of the air drawn along the secondary flow path, thus producing useful thrust. The air drawn along the primary flow path into the compressor section is compressed. The compressed air is channeled to the combustor section, where fuel is added to the compressed air, and the air-fuel mixture is burned. The products of combustion are discharged to the turbine section. The turbine section extracts work from these products to power the fan and the compressor. Any energy from the products of combustion not needed to drive the fan and compressor contributes to useful thrust.

Improvements in fan performance depend in many cases in reducing fluid flow leakage at any points in the fan. One of these places is between adjacent blade platforms. A gap typically exists between adjacent blade platforms which may result in fan blade air loss therethrough if an appropriate seal is not provided. The interplatform gap that exists between fan blades is normally a narrow space that must be sealed to prevent leakage recirculation from the blade trailing edge forward and up through the gap into the fan flow path. The seal is typically a thin and narrow rubber strip with one side portion of the seal attached to the underside of one of the fan blade platforms. The other side portion of the seal hangs loose under the gap between an adjacent platform so that when the fan starts to rotate, the seal is urged radially outwardly against the gap by centrifugal force, thereby providing an effective seal.

While such seals may be generally effective, they may be unsatisfactory in certain applications. For example, certain fan blades such as those associated with modern impact resistant fan blades, have larger interplatform gaps therebetween. Similarly, other blading configurations may exist which require increased local gaps between platforms. Prior art seals would be unable to effectively seal against leakage or bridge the large gap due to centrifugal forces. The seals would be pushed through the gap and thus be ineffective in sealing. The resultant leakage of fluid flow due to ineffective sealing would enter the fan flow path. This mixing of leakage fluid flow with the fluid in the fan flow path contributes to fan inefficiency.

In addition, the interplatform seals have to allow for fan blade maintenance. The seals have to accommodate radial and circumferential motion during assembly and disassembly of fan blades. Thus, the best type of seal is one that allows for ease of maintenance of associated fan blades and prevents leakage recirculation from the interplatform gaps. Prior art seals, though flexible, are not rigid enough to bridge the relatively large interplatform gaps associated with modern impact resistant fan blades.

SUMMARY OF THE INVENTION

According to the present invention, a seal stiffened to reduce fluid flow through large gaps between adjacent blade platforms for a fan in an axial flow gas turbine engine. Large interplatform gaps are associated with modern impact resistant fan blades. Due to the increased gaps, the seal has to withstand centrifugal forces across the large sealing surfaces when the fan rotates.

A primary feature of the present invention is a seal adapted to seal a large gap between platforms of adjacent blades. The seal includes a laminate of materials which strengthens the seal. In accordance with one particular embodiment of the invention, the seal comprises a plurality of layers of an elastomer such as silicone reinforced with fiberglass fabric. Another feature is a seal which includes a stiffening material sandwiched between the elastomeric layers. In accordance with one particular embodiment of the invention, the stiffening material comprises a plurality of stainless steel mesh layers. Another feature is a seal including a raised portion.

A primary advantage of the present invention is the reduction in fluid flow through the interplatform gap between circumferentially adjacent fan blade platforms. Another advantage is the flexibility of the blade platform seal which is non-interfering during radial blade disassembly and assembly. This facilitates fan blade maintenance.

The foregoing and other objects, features and advantages of the present invention will become more apparent in the light of the following detailed description of the best mode for carrying out the invention and from the accompanying drawings which illustrate an embodiment of the invention.

BEST MODE FOR CARRYING OUT THE INVENTION

Figure 1:
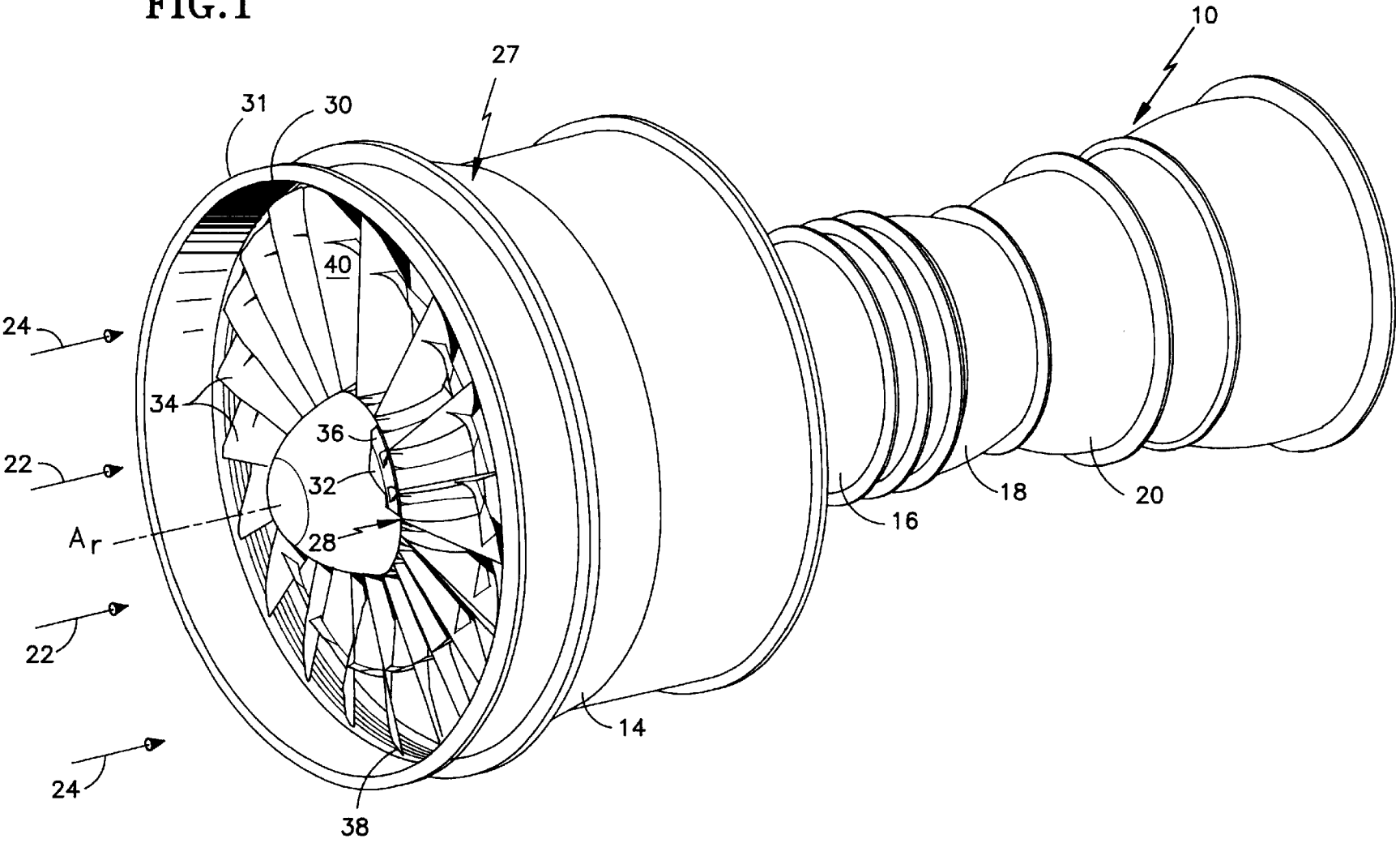
FIG. 1 is a perspective view of an axial flow, turbofan gas turbine engine.

Referring to FIG. 1, an axial flow, turbofan gas turbine engine 10 comprises of a fan section 14, a compressor section 16, a combustor section 18 and a turbine section 20. An axis of the engine $A_r$ is centrally disposed within the engine and extends longitudinally through these sections. A primary flow path 22 for working medium gases extends longitudinally along the axis $A_r$. The secondary flow path 24 for working medium gases extends parallel to and radially outward of the primary flow path 22.

The fan section 14 includes a stator assembly 27 and a rotor assembly 28. The stator assembly has a longitudinally extending fan case 30 which forms the outer wall of the secondary flow path 24. The fan case has an outer surface 31. The rotor assembly 28 includes a rotor disk 32 and a plurality of rotor blades 34. Each rotor blade 34 extends outwardly from the rotor disk 32 across the working medium flow paths 22 and 24 into proximity with the fan case 30. Each rotor blade 34 has a root portion 36, an opposed tip 38, and a midspan portion 40 extending therebetween.

Figure 2:
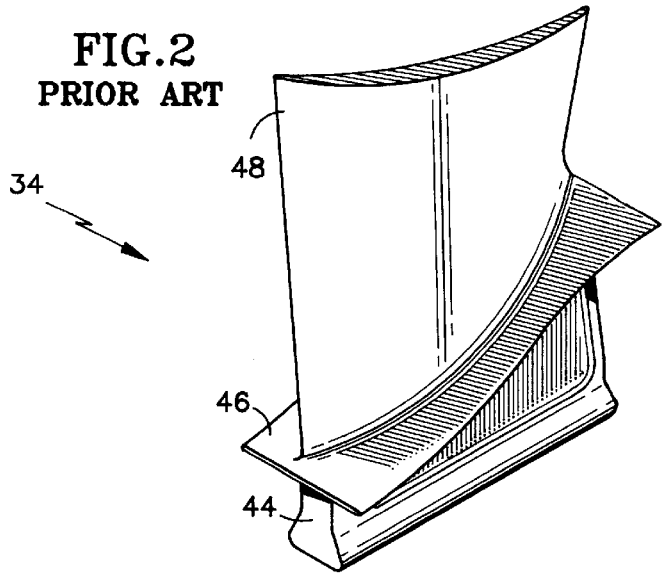
FIG.2 PRIOR ART
FIG. 2 is an isometric view of a blade of prior art for a fan in the engine of FIG. 1.

FIG. 2 shows a blade of prior art for a fan in the axial flow gas turbine engine 10 shown in FIG. 1. The fan blade 34 includes a root portion 44, a platform portion 46, and an airfoil portion 48.

Figure 3:
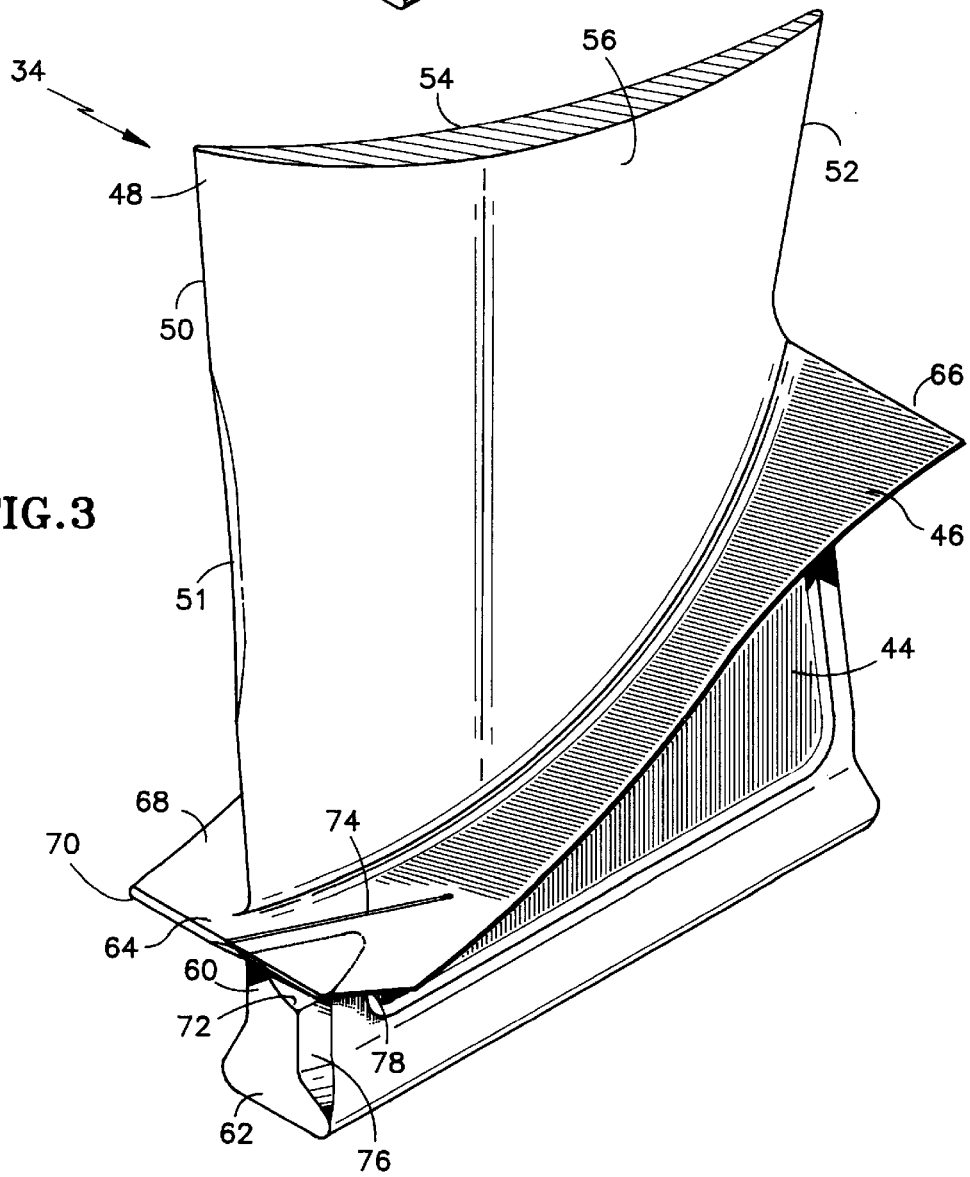
FIG. 3 is an isometric view of a blade of the present invention for a fan in the engine shown in FIG. 1.

Referring to FIG. 3, the fan blade 34 of the present invention includes a root portion 44, a platform 46 and an airfoil portion 48. The airfoil portion has a leading edge 50, a trailing edge 52, a pressure side 54 and a suction side 56. The airfoil portion is adapted to extend across the flow paths 22, 24 for the working medium gases. The root portion 44 is disposed radially inward of the airfoil portion 48 and it includes a dovetail neck 60 and a dovetail attachment 62. The platform 46 is disposed radially between the airfoil portion 48 and root portion 44. The platform 46 extends circumferentially from the blade. The platform 46 includes a leading edge portion 64 which is forward of the airfoil portion leading edge 50, a trailing edge portion 66 which is aft of the airfoil portion trailing edge 52. The platform 46 also includes an outer surface 68 defining a flow surface of the flow path and an inner surface 70 which is radially inward of the outer surface.

The fan blade 34 of the present invention includes an undercut 72 which defines a recessed area so that if the fan blade fractures the fracture is located within the dovetail neck 60. The undercut 72 is located in the inner surface 70 of the platform and extends into the dovetail neck 60 in the root portion 44. This undercut 72 moves the fillet radius between the inner surface 70 of the platform 46 and the dovetail neck 60 circumferentially away from the following blade. As a result, when the platform 46 fractures, the edge of the fracture is located within the dovetail neck 60 in the root portion 44.

The fan blade 34 of the present invention as illustrated in FIG. 3 also includes a groove 74 on the outer surface 68 of the platform 46 which is axially and circumferentially coincident with the fillet radius between the inner surface 70 of the platform 46 and dovetail neck 60 within the undercut 72. The groove 74 is a weakened area which ensures that the fracture of the platform 46 occurs at the groove 74. In addition, the leading edge of the dovetail neck 60 in the root portion 44 includes a spanwise chamfer 76 which blunts the forward corner of the dovetail neck 60. The chamfer 76 provides for a blunted corner that upon impact on the leading edge of the following blade airfoil 50 will not cause damage to the airfoil 48.

Referring to FIG. 3, the leading edge 64 of the platform is truncated 78 to provide for a blunt corner. The truncation 78 further minimizes the risk of damage to the leading edge 50 of the following blade airfoil 48 in the event the leading edge corner impacts the airfoil 48. In addition, the platform 46 is circumferentially dimensioned to define, with an adjacent platform, a large gap. This gap defines the proximity of adjacent blade platforms. An increased gap reduces the possibility of platform edges of the following adjacent blade contacting those of the released blade during a blade loss condition. The contact between adjacent platform edges causes damage to the platforms 46 which can result in fracturing the following blade platform 46.

Further, the airfoil leading edge 50 is thickened at a radial distance from the platform where the airfoil portion 48 is most likely to be impacted by a disassociated blade. The enhanced thickness is defined by a recess 51 in the leading edge at a radially inner location which provides for a stronger leading edge.

Figure 4:
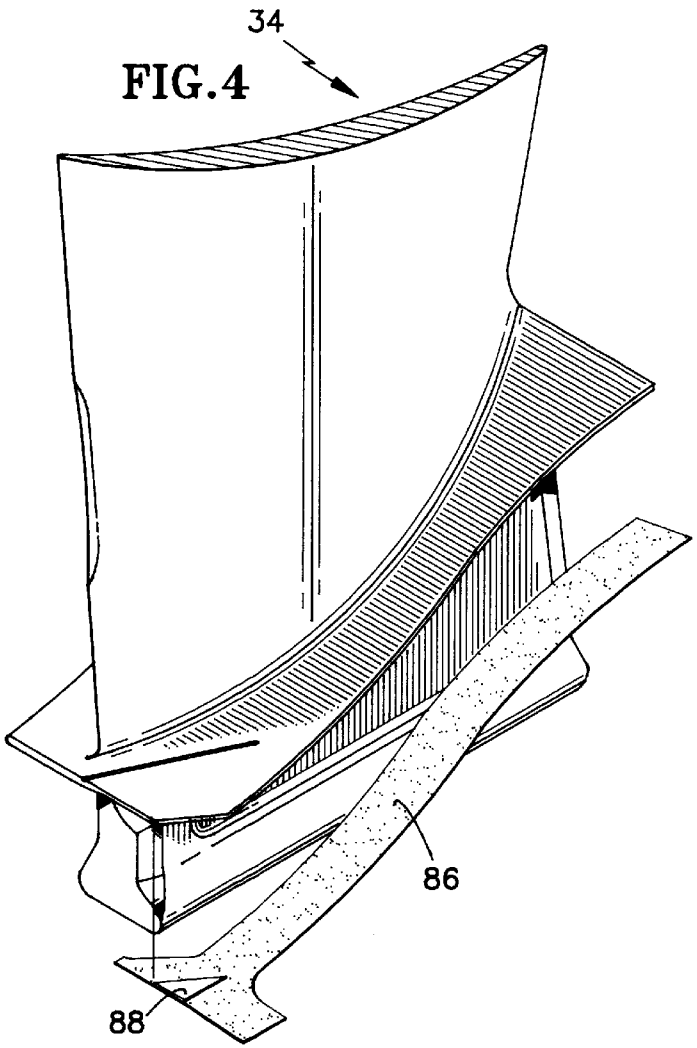
FIG. 4. is an isometric view showing the fan blade with an associated seal

FIG. 4 illustrates a seal 86 associated with the fan blade 34 of the present invention. The seal 86 is generally elastomeric. The seal is adapted to seal the locally large gap between platforms of adjacent blades. The seal includes an upstanding or raised portion 88 which is adapted to seal the gap defined by the truncation 78 in the leading edge 64 of the platform 46.

Figure 5:
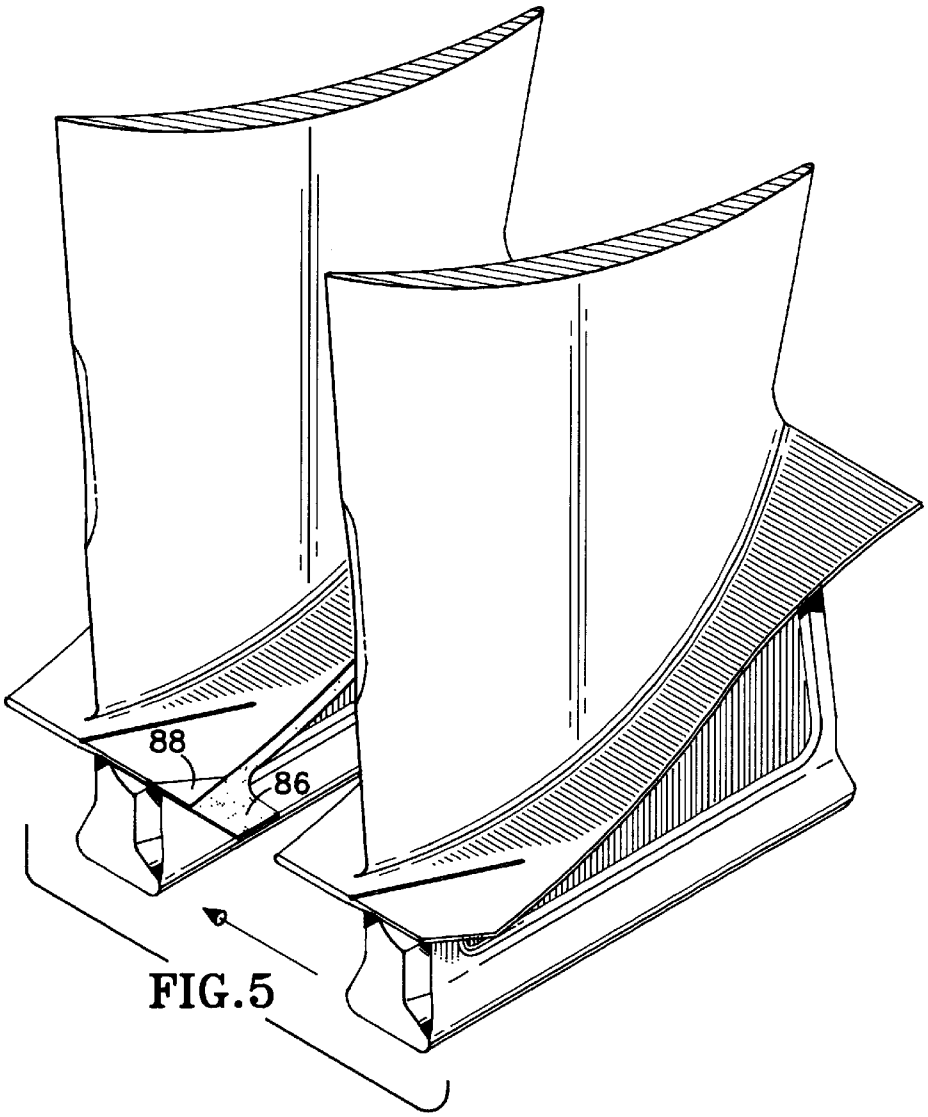
FIG. 5. is an isometric view of the seal being adapted between two adjacent fan blades.

Referring to FIG. 5, the seal 86 is interposed between two adjacent fan blade platforms 46. The seal has a radially outer major surface. The outer surface includes two opposed side portions. One side portion of the elastomeric seal 86 is fixed to the inner surface 70 of one platform 46 such as by adhesive bonding. The second side portion of the seal 86 hangs loose in the interplatform gap defined by the space between two adjacent fan blade platforms 46.

Figure 6:
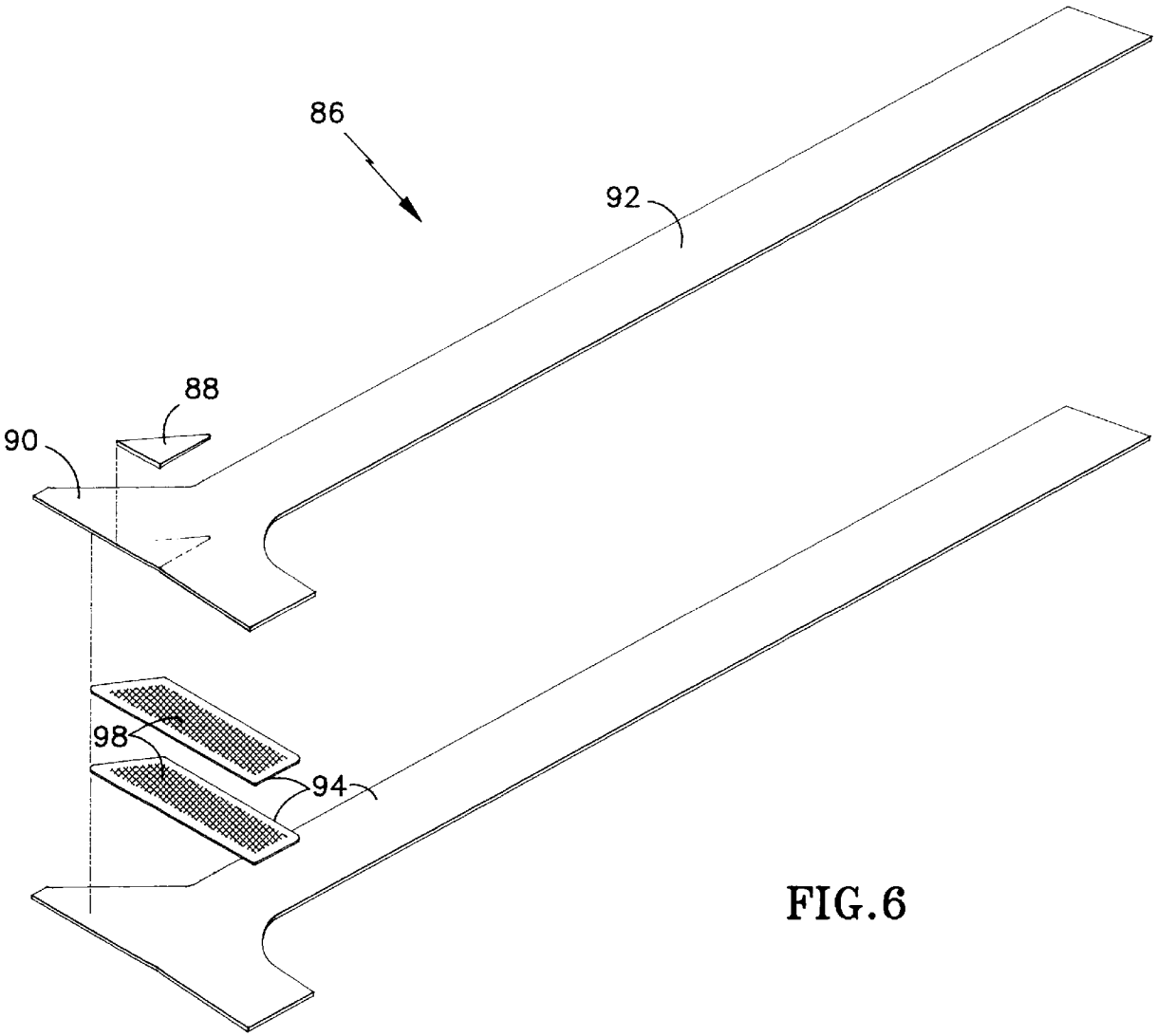
FIG. 6. is an exploded view of the seal of the present invention shown in FIG. 4.

FIG. 6 shows an exploded view of the seal 86 of the present invention shown in FIG. 4. The seal has a forward portion 90 and longitudinal aft portion 92. The forward portion 90 seals the leading edge region 64 of the platform 46. The longitudinal aft portion 92 seals the remaining interplatform gap.

The forward portion 90 comprises of a plurality of layers of silicone rubber 94 reinforced with fiberglass fabric. Sandwiched between the elastomeric layers is a plurality of layers of stainless steel mesh 98. The particular embodiment shown in FIG. 6 includes four (4) layers of silicone rubber 94 reinforced with fiberglass fabric and two (2) layers of stainless steel mesh 98 embedded therebetween.

The longitudinal aft portion 92 of the seal is comprised of a plurality of layers of silicone rubber 94 reinforced with fiberglass fabric. The particular embodiment shown in FIG. 6 includes two (2) layers of silicone rubber 94 reinforced with fiberglass fabric.

During operation of the gas turbine engine, the working medium gases are compressed in the fan section 14 and the compressor section 16. The gases are burned with fuel in the combustion section 18 to add energy to the gases. The hot, high pressure gases are expanded through the turbine section 20 to produce thrust in useful work. The work done by expanding gases drives rotor assemblies in the engines, such as the rotor assembly 28 extending to the fan section 14 about the axis of rotation $A_r$.

The gases flow along the working medium flow path at high velocities into the rotor assembly in the fan section. As the rotor assembly is rotated at high velocities, the fan blades travel at high velocities about the axis of rotation and the working medium gases are compressed in the fan flow path. As a result, the pressure at the aft trailing edge is 66 of the fan blade platforms is higher than that at the forward leading edge 64.

The fluid flow from the blade platform trailing edge 66 recirculates forward and up through the interplatform gap into the fan flow path. This recirculation is minimized by the interplatform gap seal 86 of the present invention.

One side portion of the radially outer surface of the seal is bonded to the inner surface 70 of a platform 46. During fan operation, the second opposed side portion of the radially outer surface of the seal is urged radially outwardly against the gap between an adjacent platform, thereby providing an effective interplatform gap seal.

The seal is effective for exaggerated interplatform gaps associated with modern impact resistant fan blades having relatively narrow platforms. In the preferred embodiment, the gap between platforms can be increased up to 0.75 inches. This represents an increase in the interplatform gap of up to twelve (12) times over that of prior art gaps for a given radial location of seal and fan rotational speed. The measure of seal capability is related to how big a gap the seal has to bridge and therefore seal for a given centrifugal force. The aforementioned radial location of seal and fan rotational speed provide for a measure of the centrifugal forces the seal has to withstand.

The stiffening material, such as the stainless steel mesh 98 in the preferred embodiment reinforces the seal. This is important when the interplatform gap is increased as the seal is able to withstand the centrifugal forces due to fan operation. In addition, the stainless steel mesh 98 will not damage the engine in the unlikely event the seal disassociates from a blade platform. In addition, the stainless steel mesh provides for the flexibility required by the seal to facilitate the assembly and disassembly of fan blades. The seals accommodate radial and circumferential motion during fan blade maintenance.

Although the invention has been shown and described with respect to detailed embodiments thereof, it should be understood by those skilled in the art that various changes in form and detail thereof may be made without departing from the spirit and the scope of the claimed invention.

What is claimed is:

1. In a fan in an axial flow gas turbine engine, including a blade array with a plurality of radially extending and circumferentially spaced blades, each blade having a platform including an outer surface defining a surface for fluid flowing thereover and an inner surface radially inwardly of the outer surface, a seal for reducing fluid flow through the gap between circumferentially adjacent blade platforms comprising:

multiple layers of elastomer sandwiching a stiffener therebetween such that said seal withstands centrifugal loads when sealing between platforms with large circumferential gaps.

2. A seal according to claim 1, wherein the stiffener is a plurality of layers of stainless steel mesh.

3. A seal according to claim 1, wherein each of the elastomeric layers is reinforced with fiberglass fabric embedded therein.

4. A fan in an axial flow gas turbine engine disposed about a longitudinal axis, the gas turbine engine including an axial flow path defining a passage for working medium gases, the fan comprising:

a blade array with a plurality of radially extending and circumferentially space blades, each blade having a platform including a leading edge portion forward of the airfoil portion leading edge, a trailing edge portion aft of the airfoil portion trailing edge, an outer surface defining a flow surface of the flow path, and an inner surface radially inward of the outer surface, wherein adjacent blade platforms are separated by a gap therebetween; and a seal including a forward portion and a longitudinal aft portion, the forward portion including a plurality of elastomeric layers reinforced with fiberglass fabric embedded therein and a plurality of layers of stainless steel mesh sandwiched therebetween, the aft portion including a plurality of elastomeric layers reinforced with fiberglass fabric;

the seal further having a radially outer surface including first and second opposed side portion being circumferentially spaced, the first side portion being bonded to the radially inner surface of said platform, the second side portion being unattached to any surface, wherein during fan operation the second side portion of the seal is circumferentially urged into engagement with the inner surface of an adjacent platform thus reducing any fluid flow in said gap between platforms.

* * * * *